United States Patent [19]

Wisseman

[11] Patent Number: 4,689,576

[45] Date of Patent: Aug. 25, 1987

[54] LINEARIZATION CIRCUIT

[75] Inventor: Leo L. Wisseman, Chandler, Ariz.

[73] Assignee: Motorola, Inc., Schaumburg, Ill.

[21] Appl. No.: 762,082

[22] Filed: Aug. 2, 1985

[51] Int. Cl.[4] ..... G06G 7/24; G06G 7/10

[52] U.S. Cl. ..... 328/143; 328/145; 307/491

[58] Field of Search ..... 328/143–146, 328/184, 150; 307/490–494; 330/149

[56] References Cited

U.S. PATENT DOCUMENTS

| | | | |
|---|---|---|---|
| 3,130,325 | 4/1964 | Rubin et al. | 307/491 |
| 3,252,007 | 5/1966 | Saari | 307/491 |
| 3,483,475 | 12/1969 | Mitchel | 328/145 |
| 3,560,864 | 2/1971 | Nihof | 328/146 |
| 3,644,836 | 2/1972 | Johnson | 328/143 |
| 3,712,989 | 1/1973 | Barton | 328/145 |
| 4,219,152 | 8/1980 | Couch et al. | 328/146 |

*Primary Examiner*—Stanley D. Miller
*Assistant Examiner*—B. P. Davis
*Attorney, Agent, or Firm*—Maurice J. Jones, Jr.; Raymond J. Warren; Eugene A. Parsons

[57] ABSTRACT

An apparatus and method is described for linearizing a non-linear device. This circuit consists of a detecting device for detecting a signal when received. A feedback device for providing a feedback signal. An operational amplifier and a bias means. These devices are coupled to provide an output that is linearly dependent upon the input to the circuit and not upon the amplitude of the signal received.

7 Claims, 10 Drawing Figures

—PRIOR ART—

—PRIOR ART—

—PRIOR ART—

LINEARIZATION CIRCUIT

BACKGROUND OF THE INVENTION

This invention relates, in general, to linearization circuits and, more particularly, to circuits for linearizing non-linear devices.

This device was developed for use in transponders. The problem addressed herein involves errors developed when determining the distance of an object from a fixed point. A signal is transmitted from a known point to the object. This signal is then retransmitted by the object to the known point. By measuring the time delay from transmission to reception of the signal, after being corrected for circuitry delay, the distance from the known point to the object may be determined.

At the variable distances being measured the amplitude of the received signal will change. This causes the time delay of the detected pulse to vary (due to the pulse detection circuitry). This delay variation must be compensated to reduce or eliminate its effects.

SUMMARY OF THE INVENTION

Accordingly, it is an object of the present invention to provide a linearization circuit and method that overcomes the deficiencies set out above.

A further object of the present invention is to provide a linearization circuit and method that improves delay variations versus pulse amplitude in the involved devices.

Another object of the present invention is to provide a linearization circuit and method that will improve system performance.

A particular embodiment of the present invention consists of a linearization circuit having a first input, a second input and an output. The linearization circuit consists of a detector means, a feedback means, an operational amplifier, and a bias means. The detector means has a first port and a second port, the first port is coupled to the first input of the linearization circuit. The feedback means has a first port and a second port: the first port is coupled to the second port of the detector means; and the second port is coupled to the output of the linearization circuit. The operational amplifier has an input of a first polarity, an input of a second polarity, and an output. The input of a first polarity is coupled to the second port of the detector and the first port of the feedback means. The output of the operational amplifier is coupled to the second port of the feedback means and the output of the linearization device. The bias means has a first port and a second port: the first port is coupled to the second input of the linearization circuit; and the second port is coupled to the input of a second polarity of the operational amplifier.

DETAILED DESCRIPTION OF THE DRAWINGS

Figure 1:
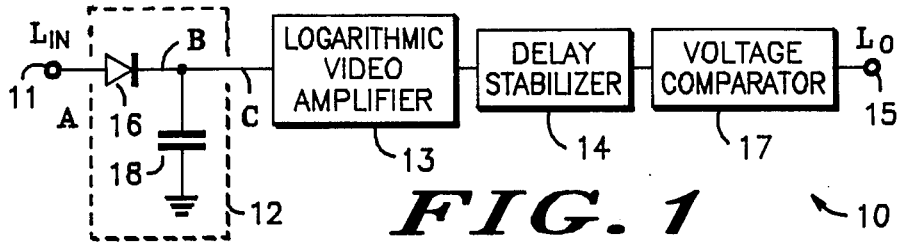
FIG. 1 illustrates a block diagram of a prior art device used to correct errors in a received signal.

FIG. 1 illustrates a.block diagram of a prior art correction device, generally designated 10. Device 10 consists of a detector 12 having an input coupled to a node 11 for receipt of an input signal, $L_{in}$. The output of detector 12 is coupled to the input of a logarithmic video amplifier 13. The output of amplifier 13 is coupled to the input of a delay stabilizer 14. The output of delay stabilizer 14 is coupled to the input of a voltage comparator 17. The output of comparator 17 is coupled to a node 15 where an output signal is provided.

Figure 2:
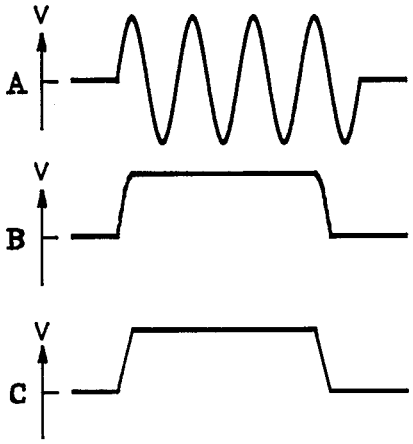
FIG. 2 illustrates the signals found at various points in the circuit of FIG. 1.

In operation, a signal is transmitted from a known location to the device contained in circuit 10. The signal transmitted is normally in the microwave range. The signal is received and transmitted to device 10 at node 11. The signal is then transmitted to a diode 16 in detector 12. The signal received is normally a burst of sinusoidal waves as illustrated in FIG. 2, graph A. Diode 16 operates to cut-off the negative portion of the signal and provide a signal having the form illustrated in FIG. 2, graph B. A capacitor 18 in detector 12 is charged by the remaining positive signal to produce the signal shown in FIG. 2, graph C. The signal is then processed through amplifier 13 and stablizer 14 to provide a signal, $L_o$, to stablizer 14 and to drive voltage comparator 17.

Figure 3:
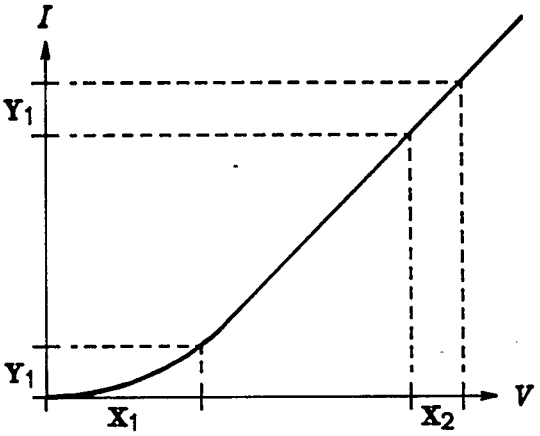
FIG. 3 illustrates a graph of a voltage-current response curve for a portion of the circuit in FIG. 1.

One of the problems here is derived from diode 16. The standard V-I curve of detector 12 starts as a nonlinear curve and eventually becomes linear as the diodes internal resistance becomes dominant. This is shown in FIG. 3. In FIG. 3, when the voltage is a low change in voltage, $X_1$, will cause change in current, $Y_1$. When the voltage is at a higher level a smaller change in voltage, $X_2$, will cause the same change in current, $Y_1$. This inconsistency causes errors in processing. Because of this error, delay stabilizer 14 is required in the circuit. Delay stabilizer 14 receives an amplified signal from amplifier 13. Delay stabilizer 14 takes the delay of the pulse and provides a pulse output independent of the pulse amplitude received.

Figure 4:
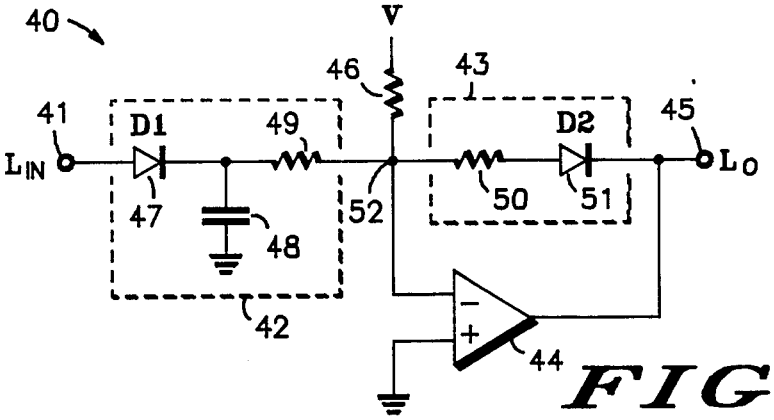
FIG. 4 is a schematic diagram of one embodiment of the present invention.

Referring now to the diagram of FIG. 4, a linearization circuit, generally designated 40, embodying the present invention is illustrated. Circuit 40 consists of a detector 42; a feedback circuit 43; and an operational amplifier 44. Detector 42 has an input coupled to a node 41 for receiving an input signal, $L_{in}$. The output of detector 42 is coupled to a node 52 which has coupled thereto one lead of feedback circuit 43; one lead of a resistor 46; and the negative input of operational amplifier 44. The second lead of feedback circuit 43 is coupled to the output of operational amplifier 44 and to an output node 45 of circuit 40. The second end of resistor 46 is connected to a voltage. The positive input of operational amplifier 44 is coupled to ground.

Detector 42 consists of a diode 47, a capacitor 48, and a resistor 49. The input signal, $L_{in}$, is received at the node 41 and transmitted to the input of detector 42.

Detector 42 functions much the same way as detector 11, FIG. 1. Resistor 46 is designed to cause a small quiescent (DC) current to be generated. This small quiescent curent produces a quiescent factor at the output which provides the correct quiescent output level which will be discussed in more detail below.

Node 52 is also coupled to a negative input of operational amplifier 44. The positive input of operational amplifier 44 is coupled to ground. The output of operational amplifier 44 is coupled to output node 45 and to one end of feedback circuit 43.

Feedback circuit 43 consists of a diode 51 having its cathode coupled to output node 45. The anode of diode 51 is coupled to one end of a resistor 50. The second end of resistor 50 is coupled to node 52.

Figure 5:
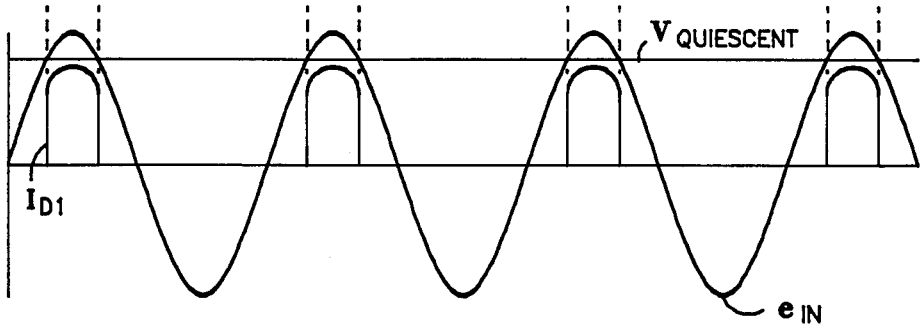
FIG. 5 is a signal diagram of various points of the embodiment of FIG. 4.
Figure 6:
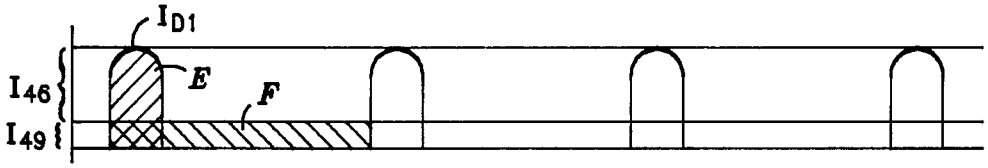
FIG. 6 is a current signal diagram of various points of the embodiment of FIG. 4.

In FIG. 5 a signal diagram is illustrated for circuit 12 and 40, FIGS. 1 and 4. The sinewave $e_{in}$ represents the AC voltage of $L_{in}$, FIGS. 1 and 4. The line $V_{quiescent}$ represents the quiescent voltage level of $L_{in}$ in circuit 40 and C in circuit 12. The voltage signal $e_{in}$ and $V_{quiescent}$ define the current of D1 which is represented as signal $I_{D1}$, FIG. 5. In FIG. 6 the current signal $I_{D1}$ is repeated, each pulse having an area represented by the crosshatched area E. The line in FIG. 6 represents the current through resistor 49, $I_{49}$. The crosshatched area F in FIG. 6 is the same as area E. A current, $I_{46}$, is set by selecting the appropriate voltage level, V, FIG. 4. Voltage V is generally selected to create a current $I_{46}$ in resistor 46, so that when $I_{46}$ and $I_{49}$ are added together at node 52 a total current approximately that of the peak current of $I_{D1}$ is created. This current, $I_{46}$ and $I_{49}$, is then transmitted out of node 52 to bias 43. This results in the diode current levels of $D_1$ and $D_2$ being equivalent at the selected current value. In addition, since the current through diodes 47 and 51 is the same level; and since diode 47 and 51 are identical, the voltage level input to circuit 40 is the same as the output, only inverted. If an output voltage of the same polarity is desired then the OpAmp 44 may be operated in a non-inventing mode.

Figure 7:
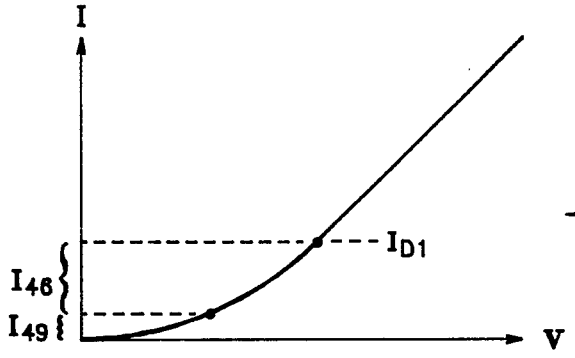
FIG. 7 is a voltage current curve for a portion of the embodiment of FIG. 4.

By way of a further example FIG. 7 shows a voltage-current curve similar to that of FIG. 3. Since diodes 47 and 51 are of the same type the V-I curves for both are also the same. The current through diode 47 is represented by $I_{D1}$. The current through diode 51, if current $I_{46}$ was not provided, is represented by $I_{49}$. As can be seen by examining the graph, these two currents, and associated voltage levels, are not linearly related unless the currents are extremely small. The addition of current $I_{46}$ increases the current level in diode 51 to be equivalent to that of the pulse current in diode 47. This provides a linear relation between the input and output of circuit 40.

Figure 8:
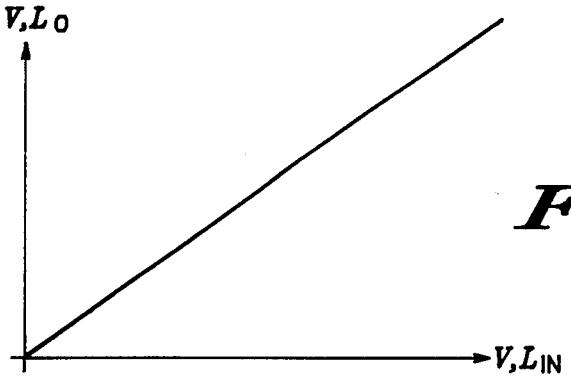
FIG. 8 is a graph of the input voltage versus the output voltage of FIG. 4.

A linear relationship between the voltages of $L_O$ and $L_{in}$ is shown in FIG. 8. The linear relationship illustrated here is not necessarily intended to be a one-to-one relation, but a one-to-"X" where "X" remains vertically constant throughout.

Figure 9:
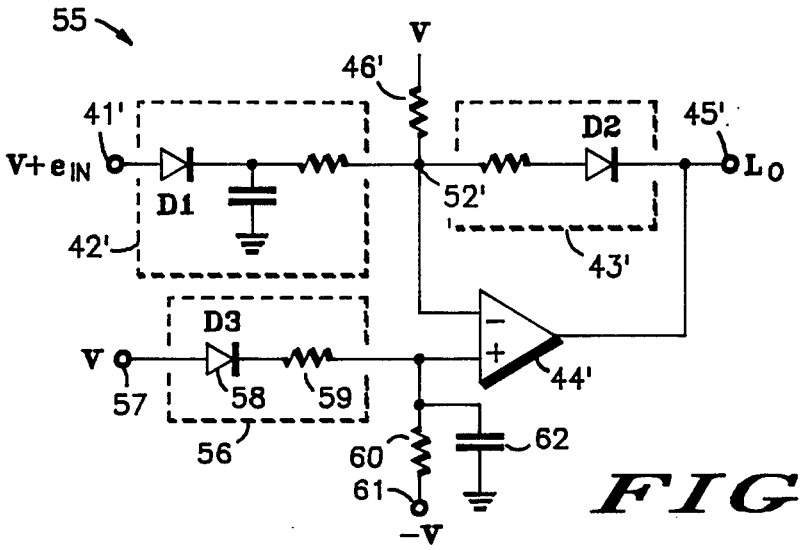
FIG. 9 is a schematic diagram of a second embodiment of the present invention.

Referring now to FIG. 9, a second embodiment of the present invention generally designated 55, is illustrated. In FIG. 9 the portions that correspond to those in FIG. 4 are numbered the same with a prime added. The input signal is received at a node 41'. Here the input signal does not have to contain the DC portion ($V_{quiescent}$), just the AC portion ($e_{in}$). In FIG. 4 it was assumed that node 41 contained the DC portion and AC portions and would not be coupled to ground. To enable node 41 to be coupled to ground a bias circuit 56 is required.

The input of bias circuit 56 is coupled to a node 57 which receives an input signal equivalent to $V_{quiescent}$ of node 41', which could be ground. The input of bias circuit 56 is coupled to the anode of a diode 58, D3. The cathode of diode 58 is coupled to one end of a resistor 59. The second end of resistor 59 is coupled to the positive input of operational amplifier 44'. A resistor 60 has one end coupled to the positive input of operational amplifier 44'. The second end of resistor 60 is coupled to a node 61 which receives a, −V, voltage signal. It should be noted that diode polarities and voltages may be reversed. A capacitor 62 is coupled to the positive input of operational amplifier 44' at one end with the second end coupled to ground. Resistor 60 is used, as described in more detail presently, to set the bias current in diodes D1, D2, and D3. Capacitor 62 is a bypass and noise reduction capacitor.

Bias circuitry 56, 60, and 62 will also serve to temperature compensate circuit 55. The current through diode 58 will vary slightly with change in temperature. This changes the V-I characteristic of diode 58 which will change the current flow through diode 58. This causes a change in the voltage at the input of OpAmp 44'. This in turn causes a change in the output voltage of OpAmp 44' which, through feedback 43' causes a change in the voltage level at the − input of OpAmp 44'. This process balances the voltages at the + and − inputs of OpAmp 44'. This change in voltage at the − input of OpAmp 44' causes a change in the current through detector 42'. Since diodes D3 and D1 are identical, the current through D1 is set to that of D3. With respect to the linearization of circuit 55, it operates the same as circuit 40, FIG. 4.

Circuit 55 is also used, as referred to above, if the input to diode D1 is to be DC grounded. Then the input to diode D3 would also be DC grounded. This would cause a current to be drawn through bias circuit 56 creating a voltage at the + input of OpAmp 44' which, as above, causes the same voltage at the − input of OpAmp 44' and cause a current to be drawn through diode D1 equal to that through D3.

Figure 10:
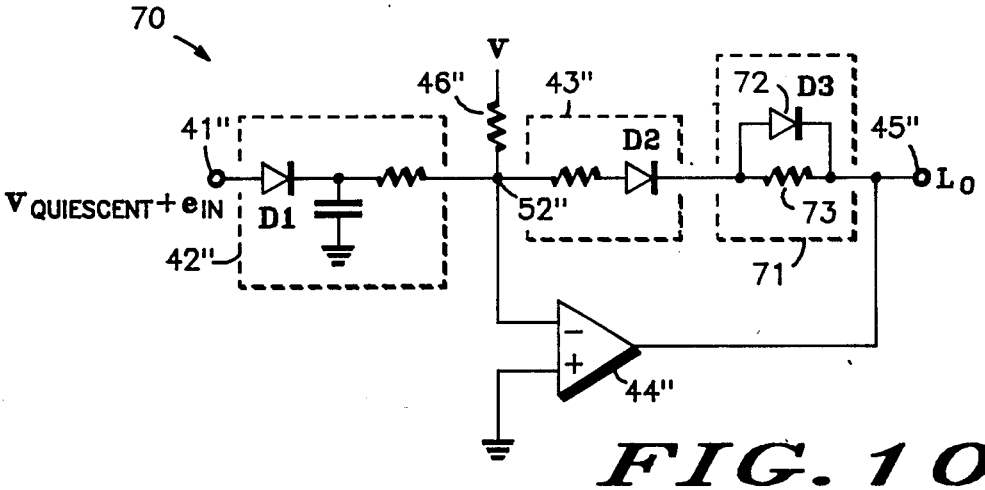
FIG. 10 is a schematic diagram of a third embodiment of the present invention.

Referring now to the schematic diagram of FIG. 10, a linearization circuit, generally designated 70, embodying the present invention is illustrated. In FIG. 10 the portions that correspond to those used in circuit 55, FIG. 6, are numbered the same with the use of a double prime to distinguish them. Circuit 70 has a gain and limiting circuit 71 coupled between the output of feedback circuit 43'' and the output node 45''. Gain and limiting circuit 71 consists of a diode 72 and a resistor 73. Diode 72 has an anode coupled to the output of feedback 43'' and a cathode coupled to the output of 45''. Resistor 73 has a first end coupled to the output of feedback circuit 43'' and a second end coupled to output node 45''.

Gain and limiting circuit 71 serves to amplify the output of feedback circuit 43''. In FIG. 4, since the current through D2 is the same as that through D1, the voltage level at the output of D2 is the same as D1, although inverted. By adding diode 72, D3, identical to diodes D1 and D2, the voltage at output node 45'' is doubled. As the same current that passes through diode D2 passes through diode D3, the same change in voltage access D3 is provided as is found across D2. By way of example, if a voltage signal of 0.5 volts were applied to D1 a current Y would be produced through a diode D1. The current output from detector 42'' would be added to that from resistor 46'', see FIG. 4 and associated discussion, to provide a current Y into feedback 43". This produces a voltage at the output of feedback 43" of −0.5 volts. Current Y then passes through network 71. Diode D3 creates an additional 0.5 volt drop from the input voltage giving a voltage at its output of −1.0 volts. Therefore, by providing the required number of diodes the voltage output may be amplified.

Thus, it is apparent that there has been provided in accordance with the invention, a device and method that fully satisfies the objects, aims and advantages set forth above.

It has been shown that the present invention provides an improved delay variation versus pulse amplitude of the device.

While the invention has been described in conjunction with specific embodiments thereof, many alterations, modifications, and variations will be apparent to those skilled in the art in light of the foregoing description. Accordingly, it is intended to embrace all such alterations, modifications, and variations in the appended claims.

What is claimed is:

1. A linearization circuit having a first input, a second input and an output, comprising:

detector means for detecting a signal, said detector means having a first port and a second port, said first port being coupled to said first input of said linearization circuit;

feedback means for providing a feedback signal, said feedback means having a first port and a second port, said first port being coupled to said second port of said detector means and said second port being coupled to said output of said linearization circuit;

an operational amplifier having an input of a first polarity, an input of a second polarity and an output, said input of a first polarity being coupled to said second port of said detector means and said first port of said feedback means, and said output being coupled to said second port of said feedback means and said output of said linearization device; and bias means for biasing said linearization circuit, said bias means having a first port and a second port, said first port being coupled to said second input of said linearization circuit, and said second port being coupled to said input of a second polarity of said operational amplifier wherein said bias means includes a diode having an anode and a cathode, said anode being coupled to said second input of said linearization circuit and a first resistor having a first port and a second port, said first port being coupled to said cathode of said diode and said second port being coupled to said input of a second polarity of said operational amplifier.

2. The linearization circuit of claim 1 further comprising:

a second resistor having a first port and a second port, said first port being coupled to said second port of said bias means and to said input of a second polarity of said operational amplifier, and said second port being coupled to a voltage source; and a capacitor having a first port and a second port, said first port being coupled to said input of a second polarity of said operational amplifier and to said second port of said bias means, and said second port being coupled to a ground.

3. The linearization circuit of claim 1 further comprising limiting means for limiting the gain of the linearization circuit, said limiting means having a first port and a second port, said first port being coupled to said second port of said feedback means and said second port being coupled to said output of said operational amplifier and to said output of said linearization circuit.

4. The linearization circuit of claim 3 wherein said limiting means comprises:

a diode having an anode and a cathode, said anode being coupled to said second port of said feedback means, and said cathode being coupled to said output of said operational amplifier and to said output of linearization circuit; and a resistor having a first port and a second port, said first port being coupled to said second port of said feedback means, and said second port being coupled to said output of said operational amplifier and to said output of said linearization circuit.

5. A linearization device having an input, a ground, a reference, and an output, comprising:

a first diode having an anode and a cathode, said anode being coupled to said input of said linearization device;

a first resistor having a first port and a second port, said first port being coupled to said cathode of said first diode;

a capacitor having a first port and a second port, said first port being coupled to said cathode of said first diode and said first port of said first resistor, and said second port being coupled to said ground;

a second resistor having a first port and a second port, said first port being coupled to said reference and said second port being coupled to said second port of said first resistor;

an operational amplifier having an input of a first polarity, an input of a second polarity, and an output, said input of a first polarity being coupled to said second port of said first resistor and to said second port of said second resistor, and said input of a second polarity being coupled to said ground;

a third resistor having a first port and a second port, said first port being coupled to said second port of said first resistor, to said second port of said second resistor, and to said input of a first polarity of said operational amplifier; and a second diode having an anode and a cathode, said anode being coupled to said second port of said third resistor and said anode being coupled to said output of said operational amplifier and to said output of said linearization device.

6. A linearization device having a first input, a second input, a voltage source, a ground, and an output, said linearization device comprising:

a first diode having an anode and cathode, said anode being coupled to said first input of said linearization device;

a first resistor having a first port and a second port, said first port being coupled to said cathode of said first diode;

a first capacitor having a first port and a second port, said first port being coupled to said cathode of said first diode and to said first port of said first resistor, and said second port being coupled to said ground;

an operational amplifier having an input of a first polarity, an input of a second polarity, and an output, said input of a first polarity being coupled to said second port of said first resistor, and said output being coupled to said output of said linearization device;

a second resistor having a first port and a second port, said first port being coupled to said second port of said first resistor and to said input of a first polarity of said operational amplifier;

a second diode having an anode and a cathode, said anode being coupled to said second port of said second resistor and said anode being coupled to said output of said operational amplifier and said output of said linearization device;

a third diode having an anode and a cathode, said anode being coupled to said second input of said linearization device;

a third resistor having a first port and a second port, said first port being coupled to said cathode of said third diode and said second port being coupled to said input of a second polarity of said operational amplifier;

a fourth resistor having a first port and a second port, said first port being coupled to said second port of said third resistor and said input of a second polarization of said operational amplifier, and said second port being coupled to said power supply of said linearization circuit; and a second capacitor having a first port and a second port, said first port being coupled to said first port of said fourth resistor and said second port being coupled to said ground.

7. The linearization circuit of claim 6 further comprising:

a fourth diode having an anode and a cathode, said anode being coupled to said cathode of said second diode, and said cathode being coupled to said output of said operational amplifier and said output of said linearization circuit; and a fifth resistor having a first port and a second port, said first port being coupled to said cathode of said second diode and said second port being coupled to said output of said operational amplifier and said output of said linearization circuit.

* * * * *